US005391259A

United States Patent [19]

Cathey et al.

[11] Patent Number: 5,391,259

[45] Date of Patent: Feb. 21, 1995

[54] METHOD FOR FORMING A SUBSTANTIALLY UNIFORM ARRAY OF SHARP TIPS

[75] Inventors: David A. Cathey; Kevin Tjaden, both of Boise, Id.

[73] Assignee: Micron Technology, Inc., Boise, Id.

[21] Appl. No.: 184,819

[22] Filed: Jan. 21, 1994

Related U.S. Application Data

[63] Continuation-in-part of Ser. No. 883,074, May 15, 1992, Pat. No. 5,302,238.

[51] Int. Cl.[6] ..... H01J 9/00

[52] U.S. Cl. ..... 156/643; 156/646; 156/654; 156/659.1; 156/661.1; 156/662; 445/50; 445/51

[58] Field of Search ..... 156/647, 643, 654, 646, 156/657, 662, 653, 659.1, 661.1; 445/50, 51, 24

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 313/309 |
| 3,812,559 | 5/1974 | Spindt et al. | 29/25.18 |
| 3,814,968 | 6/1974 | Nathanson et al. | 313/95 |
| 4,513,308 | 4/1985 | Greene et al. | 357/55 |
| 4,566,935 | 1/1986 | Hornbeck | 156/626 |
| 4,766,340 | 8/1988 | Van der Mast et al. | 313/366 |
| 4,806,202 | 2/1989 | Tang et al. | 156/657 |
| 4,940,916 | 7/1990 | Borel et al. | 313/306 |
| 4,968,382 | 11/1990 | Jacobson et al. | 156/657 X |
| 4,992,699 | 2/1991 | McClure et al. | 156/647 X |
| 5,064,396 | 11/1991 | Spindt | 445/50 |
| 5,083,958 | 1/1992 | Longo et al. | 156/644 X |
| 5,186,670 | 2/1993 | Doan et al. | 445/24 |
| 5,201,992 | 4/1993 | Marcus et al. | 156/643 |
| 5,220,725 | 6/1993 | Chan et al. | 156/657 X |
| 5,221,221 | 6/1993 | Okaniwa | 156/657 X |
| 5,228,877 | 7/1993 | Allaway et al. | 156/659.1 X |
| 5,229,331 | 7/1993 | Doan et al. | 437/228 |
| 5,266,530 | 11/1993 | Bagley et al. | 156/651 X |

OTHER PUBLICATIONS

R.Z. Bakhtizin, S.S. Ghots, and E.K. Ratnikova, "GaAs Field Emitter Arrays", IEEE Transactions on Electron Devices, Vol. 38, No. 10, October 1991, pgs. 2398–2400.

R.N. Thomas, R.A. Wickstrom, D.K. Schroder, and H.C. Nathanson, "Fabrication and Some Applications of Large-Area Silicon Field Emission Arrays," Solid-State Electronics, Vol. 17, 1974, pgs. 155–163.

Marcus et al., "Formation of Silicon Tips with 1 nm Radius", Appl. Physics Letter, vol. 56, No. 3, Jan. 15, 1990.

Hunt et al., "Structure and Electrical Characteristics of Silicon Field-Emission Microelectronic Devices", IEEE Transaction on Electron Devices, vol. 38, No. 10, Oct. 1991.

McGruer et al., "Oxidation-Sharpened Gated Field Emitter Array Process", IEEE Transactions on Electron Devices, vol. 38, No. 10, Oct. 1991.

Keiichi Betsui "Fabrication and Characteristics of Si Field Emitter Arrays", 1991, Fujitsu Laboratories, pp. 26–29.

*Primary Examiner*—Thi Dang

*Attorney, Agent, or Firm*—Lia M. Pappas

[57] ABSTRACT

A method for forming a substantially uniform array of atomically sharp emitter tips, comprising: patterning a substrate with a mask, thereby defining an array; isotropically etching the array to form pointed tips; and removing the mask when substantially all of the tips have become sharp. A mask having a composition and dimensions which enable the mask to remain balanced on the apex of the tips until all of the tips are of substantially the same shape is used to form the array of substantially uniform tips.

24 Claims, 4 Drawing Sheets

METHOD FOR FORMING A SUBSTANTIALLY UNIFORM ARRAY OF SHARP TIPS

CROSS-REFERENCE TO RELATED APPLICATIONS

This is a continuation-in-part application of U.S. application Ser. No. 07/883,074, filed May 15, 1992, entitled, "Plasma Dry Etch to Produce Atomically Sharp Asperities Useful as Cold Cathodes," having the Ser. No. 08/883,074, now U.S. Pat. No. 5,302,238.

The present application is related to U.S. application Ser. No. 07/884,482, filed May 15, 1992, now U.S. Pat. No. 5,302,239, entitled, "Method of making Atomically Sharp Tips useful in Scanning Probe Microscopes," assigned to Micron Technology, Inc., and having a common inventor with the present application.

FIELD OF THE INVENTION

This invention relates to display technology, and more particularly to the fabrication of an array of atomically sharp field emission tips.

BACKGROUND OF THE INVENTION

The clarity, or resolution, of a field emission display is a function of a number of factors, including emitter tip sharpness. The process of the present invention is directed toward the fabrication of very sharp cathode emitter tips.

A great deal of work has been done in the area of cold cathode tip formation. See, for example, the "Spindt" patents, U.S. Pat. Nos. 3,665,241, and 3,755,704, and 3,812,559 and 5,064,396. See also, U.S. Pat. No. 4,766,340 entitled, "Semiconductor Device having a Cold Cathode," and U.S. Pat. No. 4,940,916 entitled, "Electron Source with Micropoint Emissive Cathodes and Display Means by Cathodeluminescence Excited by Field Emission Using Said Source."

One current approach toward the creation of an array of emitter tips, is to use a mask and to etch silicon to form a tip structure, but not to completely form the tip. Prior to etching a sharp point, the mask is removed or stripped. The idea is to catch the etch at a stage before the mask is dislodged from the apex of the tip. See, for example, U.S. Pat. No. 5,201,992 to Marcus et al., entitled, "Method for Making Tapered Microminiature Silicon Structures."

Prior art teaches that it is necessary to terminate the etch at or before the mask is fully undercut to prevent the mask from being dislodged from the apex. If an etch proceeds under such circumstances, the tips become lop-sided and uneven due to the presence of the mask material along the side of the tip, or the substrate during a dry etch and additionally, the apex may be degraded, as seen in FIG. 8. Such a condition also leads to contamination problems because of the mask material randomly lying about a substrate, which will mask off regions where no masking is desirable, and continued etching will yield randomly placed, undesired structures in the material being etched.

If the etch is continued, after the mask is removed, the tip will simply become more dull. This results because the etch chemicals will remove material in all directions, thereby attacking the exposed apex of the tip while etching the sides. In addition, the apex of the tip may be degraded when the mask has been dislodged due to physical ion bombardment during a dry etch.

Hence, the tendency is to underetch (i.e, stop the etch process before a fine point is formed at the apex of the tip) the tip, thereby creating a structure referred to as a "flat top." Then, an oxidation step is typically performed to sharpen the tip. This method results in a non-uniform etch results across the array, and the tips will have different heights and shapes.

Others have tried to manufacture tips by etching, but they do not undercut the mask all the way as in the process of the present invention, and furthermore do not continue etching beyond full undercut of the mask without suffering degradation to the tip as in the process of the present invention, which allows for latitude which is required for manufacturing. Rather they remove the mask before the tip is completely undercut, and sharpen the tips from there. The wet silicon etch methods of the prior art, result in the mask being dislodged from the apex of the tip, at the point of full undercut which can contaminate the etch bath, generate false masking, and degrade the apex.

The non-uniformity among the tips may also present difficulties in subsequent manufacturing steps used in the formation of the display, especially those processes employing chemical mechanical planarization. See for example, U.S. Pat. No. 5,229,331, entitled, "Method to Form Self-Aligned Gate Structures Around Cold Cathode Emitter Tips Using Chemical Mechanical Polishing Technology," and U.S. Pat. No. 5,186,670, entitled, "Method to Form Self-Aligned Gate and Focus Rings," also assigned to Micron Technology, Inc. Non-uniformity is particularly troublesome if it is abrupt, as opposed to a gradual change across the wafer.

Fabrication of a uniform array of tips using current processes is very difficult to accomplish in a manufacturing environment for a number of reasons. For example, simple etch variability across a wafer will effect the time at which the etch should be terminated with the prior art approach.

Generally, it is difficult to attain plasma tip etches with uniformities better than 5%, with uniformities of 10%–20% being more common. This makes the "flat top" of an emitter tip etched using conventional methods vary in size. In addition, the oxidation necessary to "sharpen" or point the tip varies by as much as 20%, thereby increasing the possibility of non-uniformity among the various tips of an array.

Tip height and other critical dimensions suffer from the same effects on uniformity. Variations in the masking uniformity, and material to be etched compound the problems of etch uniformity.

Manufacturing environments require processes that produce substantially uniform and stable results. In the manufacture of an array of emitter tips, the tips should be of uniform height, aspect ratio, sharpness, and general shape, with minimum deviation, particularly in the uppermost portion.

SUMMARY OF THE INVENTION

The process of the present invention employs dry etching (also referred to as plasma etching) to fabricate sharp emitter tips. Plasma etching is the selective removal of material through the use of etching gases. It is a chemical process which uses plasma energy to drive the reaction. Those factors which control the precision of the etch include the temperature of the substrate, the time of immersion, the composition of the gaseous etchant, pressure, applied RF power, and etch hardware configuration.

The mask layer is formed such that it exposes the silicon substrate, which silicon substrate is then etched to form the sharp emitter tips.

The process of the present invention can be used to produce sharp tips with relatively any given aspect ratio and height with a single step (in situ) or multi-step plasma dry etch process.

The present invention, under some conditions provides a very large manufacturing window, particularly when the tips are etched into a layer or substrate in which the thickness of the layer is not totally consumed during the tip etch in unmasked (i.e., non-tip) regions.

In the preferred embodiment, a dry etch proceeds for about 2.3 minutes to undercut the mask and form a sharp tip. An overetch can continue the process without a substantial change in the appearance of the tips. The shape of the tip is self-repeating because the mask has been optimized to remain in place relative to the top of the emissive structure region being formed. The tip is etched vertically, as well as horizontally, and the shapes are most uniform in appearance when the rate of horizontal etching is within a factor of four to the vertical, with the most uniform results occurring after a 2:1 ratio of vertical to horizontal etching rate.

Contrary to the current teaching, the present invention involves dry etching the apex of the tip to a complete point, and continuing etching to add the requirement of process margin required in manufacturing, such that the mask appears as a see-saw or teeter-totter at equilibrium, essentially perfectly balanced on the apex of the tip.

In the preferred embodiment, a substrate of 14–21 ohms-cms P-type 1-0-0 single crystal silicon is the material from which the tips are formed. The mask in the preferred embodiment has a circular shape, and is comprised of 0.1 μm thick thermal silicon dioxide with a diameter of 1 μm. Contrary to prior art teachings, the mask can be comprised of dimensions, and material selection, such that a particular etch process of a particular material may be employed with that mask, and the mask will adhere to the tip and can be overetched, beyond full undercut without adversely effecting tip shape and uniformities.

This benefit is believed to be obtained as a result of the attractive forces between the mask and the tip, such as vander Waals, electrostatic, and electrochemical forces.

Experiments were undertaken with a variety of masks, having differing compositions and dimensions in combination with the etch conditions of the Table 1 below, and a tip material of 14–21 ohm-cm 100 p-type single crystal silicon. The mask formed from a layer of 1 μm. thick HPR 6512 photoresist (Hunt Photoresist), and 0.1 μm. thick thermal silicon dioxide stack, was found to be unsatisfactory for use in the present invention. It became dislodged from the tips during the etch process, resulting in malformed tips. This effect is believed to be influenced by the mass of the etch mask.

Other masks which were found to be unsatisfactory for use in the present invention include: a 0.4 μm. oxide mask; and a 1 μm. mask comprised solely of HPR 6512 photoresist.

However, a mask comprising 0.1 μm. thick thermal oxide has displayed very good results in the present invention, as well as a mask of 0.05 μm. thick thermal oxide.

One advantage of the process of the present invention is that it enables the fabrication of tips having more uniform distribution of tip dimensions. Another advantage is that it enables the formation of a good distribution of extremely sharp points which may be enhancedby further processing, but are enabled functional with etching as a tip formation only. Yet still another advantage is that it provides a method for overetching with a dry etch without significantly degrading the desired tip shape.

One aspect of the process of the present invention involves a method for forming a substantially uniform array of sharp emitter tips. The method comprises: patterning a substrate with a mask to define an array; dry etching the array to form pointed tips; and removing the mask when substantially all of the tips have become sharp.

Another aspect of the process of the present invention involves forming a substantially uniform array of atomically sharp tips by continually etching a masked substrate until essentially every tip of the array is of substantially uniform shape, and then removing the mask.

Yet another aspect of the process of the present invention involves a method of etching an array of sharp tips, such that the tips have substantially the same height and shape by: masking a substrate, selectively removing portions of the substrate thereby forming an array of tips, and removing the mask when a substantial majority of tips resemble a geometric plane poised on a fulcrum.

As one point becomes sharp, it continues to etch for a period of time, with the mask "following" the tip down as small amounts of material are removed from the very apex of the tip, as etching continues beyond full undercut of the mask. For this reason, once an emitter tip is etched to a point, its dimensions become fixed. All tips on a substrate continue to etch until they become sharp, at which point, they have substantially the same height, aspect ratio, and sharpness.

Oxidation of tips can be employed to provide sharper emitters with lower electric fields required to produce emission, the benefits of oxidation sharpening are more controlled and a more efficiently exploited with the tip etch of the present invention, since the tip geometry is maintained rather than altered.

BRIEF DESCRIPTION OF THE DRAWINGS

The present invention will be better understood from reading the following description of nonlimitative embodiments, with reference to the attached drawings, wherein below.

DETAILED DESCRIPTION OF THE INVENTION

Figure 1:
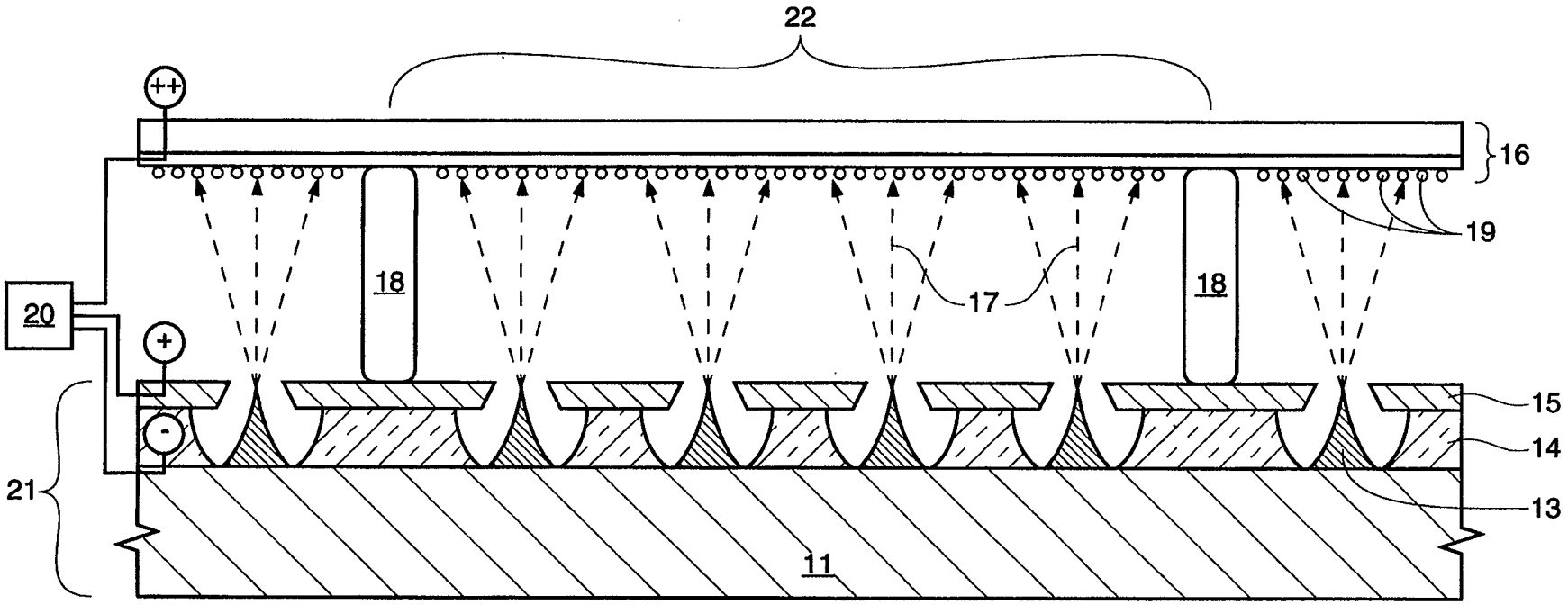
FIG. 1 is a cross-sectional schematic drawing of a pixel of a flat panel display having cathode emitter tips fabricated by the process of the present invention.

Referring to FIG. 1, a representative field emission display employing a display segment 22 is depicted. Each display segment 22 is capable of displaying a pixel of information, or a portion of a pixel, as, for example, one green dot of a red/green/blue full-color triad pixel. Preferably, a single crystal silicon layer serves as a substrate 11. Alternatively, amorphous silicon deposited on an underlying substrate comprised largely of glass or other combination may be used as long as a material capable of conducting electrical current is present on the surface of a substrate so that it can be patterned and etched to form micro-cathodes 13.

At a field emission site, a micro-cathode 13 has been constructed on top of the substrate 11. The micro-cathode 13 is a protuberance which may have a variety of shapes, such as pyramidal, conical, or other geometry which has a fine micro-point for the emission of electrons. Surrounding the micro-cathode 13, is a grid structure 15. When a voltage differential, through source 20, is applied between the cathode 13 and the grid 15, a stream of electrons 17 is emitted toward a phosphor coated screen 16. Screen 16 is an anode.

The electron emission tip 13 is integral with substrate 11, and serves as a cathode. Gate 15 serves as a grid structure for applying an electrical field potential to its respective cathode 13.

A dielectric insulating layer 14 is deposited on the conductive cathode 13, which cathode 13 can be formed from the substrate or from one or more deposited conductive films, such as a chromium amorphous silicon bilayer. The insulator 14 also has an opening at the field emission site location.

Disposed between said faceplate 16 and said baseplate 21 are located spacer support structures 18 which function to support the atmospheric pressure which exists on the electrode faceplate 16 as a result of the vacuum which is created between the baseplate 21 and faceplate 16 for the proper functioning of the emitter tips 13.

The baseplate 21 of the invention comprises a matrix addressable array of cold cathode emission structures 13, the substrate 11 on which the emission structures 13 are created, the insulating layer 14, and the anode grid 15.

In the process of the present invention, the mask dimensions, the balancing of the gases, and parameters in the plasma etch will enable the manufacturer to determine, and thereby significantly control, the dimensions of the tip 13. The composition and dimensions of the mask effects the ability of the mask 30 to remain balanced at the apex of the emitter tip 13, and to remain centered on the apex of the tip 13 during the overetch of the tip 13. "Overetch" referring to the time period when the etch process is continued after a substantially full undercut is achieved. "Full undercut" refers to the point at which the lateral removal of material is equal to the original lateral dimension of the mask 30.

Figure 2:
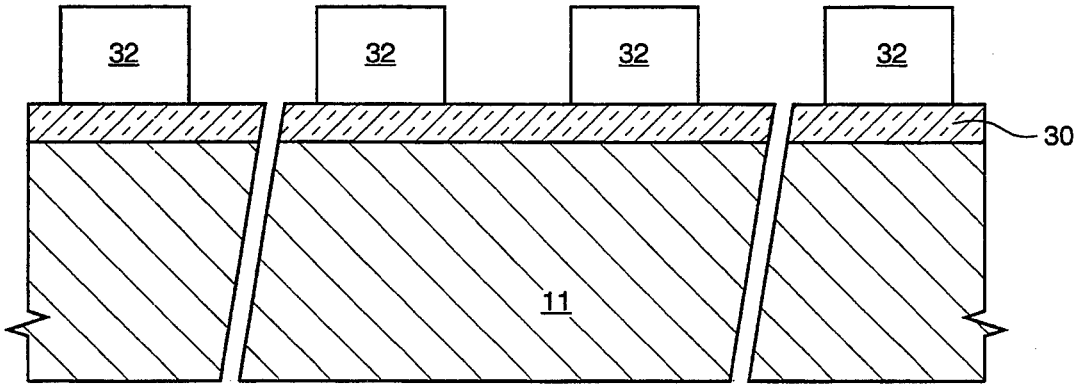
FIG. 2 is a cross-sectional schematic drawing of a substrate on which is deposited or grown a mask layer and a patterned photoresist layer, according to the process of the present invention.

FIG. 2 depicts the substrate 11, which substrate 11 can be amorphous silicon overlying glass, polysilicon, or any other material from which the emitter tip 13 can be fabricated. The discussion refers to tips 13, however sharp edges can also be micro-machined by the process of the present invention. The sharp edges alternatively serve as emitters in field emission devices.

The present invention uses a substrate 11 which, in the preferred embodiment includes a single crystal silicon. However, a deposited material, such as polysilicon or amorphous silicon, or carbon or other metal or suitable substrate 11 material may also be used. Typically, these are semiconductor wafers, although it is possible to use other materials, such as silicon on sapphire (SOS). Therefore, "wafers" is intended to refer to the substrate 11 on which the inventive emitter tips 13 are formed.

The substrate 11 has a mask layer 30 deposited or grown thereon. In the process of the present invention, 0.1 μm of silicon dioxide 30 is formed on a wafer, and functions as the mask layer 30. Tip geometries and dimensions, and conditions for the etch process will vary with the type of material used to form the tips 13, since the specific electrochemical, electrostatic, vander Waals, and interactive surface forces will vary with material.

The mask layer 30 can be made of any suitable material such that its thickness is great enough to avoid being completely consumed during the etching process, yet not so thick as to overcome the adherent forces which maintain it in the correct position with respect to the tip 13 throughout the etch process.

A photoresist layer 32 or other protective element is patterned on the mask layer 30, if the desired masking material cannot be directly patterned or applied. In the case in which the photoresist layer 32 is patterned, the most preferred shapes are dots or circles.

It is contemplated that future embodiments will comprise the use of photoresist 32 as the mask 30 itself, having optimized properties and dimensions which will enable the mask 32 to remain balanced at the tip 13 apex after full undercut is achieved.

Figure 3:
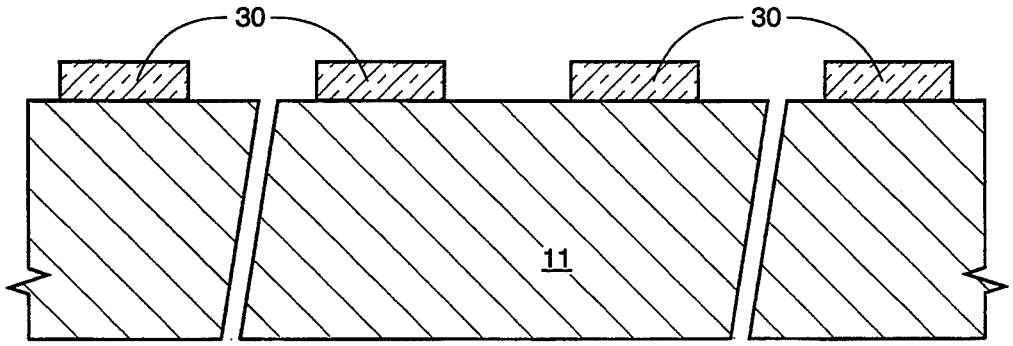
FIG. 3 is a cross-sectional schematic drawing of the structure of FIG. 2, after the mask layer has been selectively removed by plasma dry etch, according to the process of the present invention.
Figure 4:
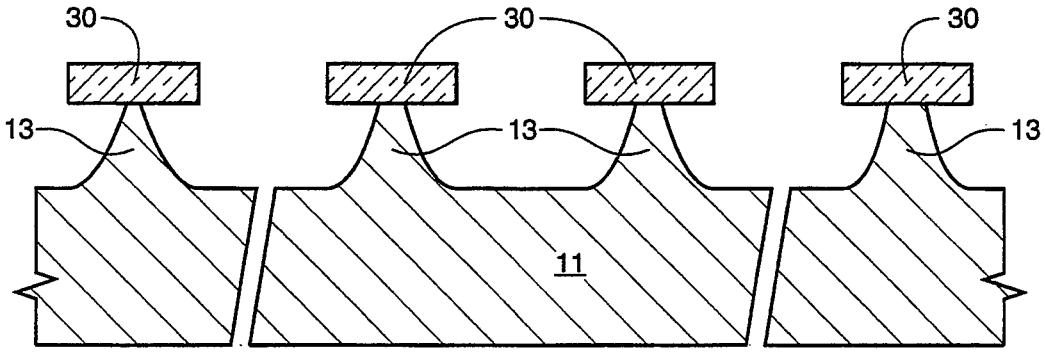
FIG. 4 is a cross-sectional schematic drawing of the structure of FIG. 3, during the etch process of the present invention.

The next step in the process is the selective removal of the mask 30 which is not covered by the photoresist pattern 32 (FIG. 3). The selective removal of the mask 30 is accomplished preferably through a wet chemical etch. An aqueous HF solution can be used in the case of a silicon dioxide mask 30, however, any suitable technique known in the industry may also be employed, including a physical or plasma removal.

In a plasma etch method, the typical etchants used to etch silicon dioxide include, but are not limited to: chlorine and fluorine, and typical gas compounds include: $CF_4$, $CHF_3$, $C_2F_6$, and $C_3F_8$. Fluorine with oxygen can also be used to accomplish the oxide mask 30 etch step. In our experiments $CF_4$, $CHF_3$, and argon were used. The etchant gases are selective with respect to silicon, and the etch rate of oxide is known in the art, so the endpoint of the etch step can be calculated.

Alternatively, a wet oxide etch can also be performed using common oxide etch chemicals.

At this stage, the photoresist layer 32 is stripped. FIG. 3 depicts the masked 30 structure prior to the silicon etch step.

A plasma etch with selectivity to the etch mask 30 is employed to form the tip, preferably, in the case of silicon a plasma containing a fluorinated gas, such as $SF_6$, $NF_3$, or $CF_4$, in combination with a chlorinated gas, such as HCl or $Cl_2$. Most preferably the plasma comprises a combination of $SF_6$ and $Cl_2$, having an additive, such as helium.

The etch continues until all of the tips 13 on a wafer have completely undercut the mask 32. It is believed that vander Waals forces, electro-static, electrochemical attraction, and/or attractive surface forces have a role in securing the mask in place during continued etching.

The following are the ranges of parameters for the process described in the present application. Included is a range of values investigated during the characterization of the process as well as a range of values which provided the best results for tips 13 that were from 0.70 μm to 1.75 μm high and 1μm to 1.5 μm at the base. One having ordinary skill in the art will realize that the values can be varied to obtain tips 13 having other height and width dimensions.

TABLE 1

| PARAMETER | INVESTIGATED RANGE | PREFERRED RANGE |
|---|---|---|
| $Cl_2$ | 9–20 SCCM | 8–12 SCCM |
| $SF_6$ | 5–55 SCCM | 45–55 SCCM |
| He | 35–65 SCCM | 40–60 SCCM |
| $O_2$ | 0–20 SCCM | 0 SCCM |
| POWER | 50–250 W | 100–200 W |
| PRESSURE | 100–800 MTORR | 300–500 MTORR |
| ELECTRODE SPACING | 1.0–2.5 CM | 1.8–2.0 CM |
| TIME | 1–5.5 MIN | 2–3 MIN |

Experiments were conducted on a Lam 490 etcher with enhanced cooling. The lower electrode was maintained substantially in the range of 21° C. However, it is anticipated that a Lam 480 or 490 etcher without enhanced cooling would also work within the specified ranges.

The primary means of controlling the height to width ratio of the tip 13 formed by the process of the present invention is through the combination of feed gases, power, and pressure during the plasma etching of the tips 13.

The ability to continue the etch to its conclusion (i.e., past full undercut) with minimal changes to the functional shape between the first tip 13 to become sharp and the last tip to become sharp, provides a process in which all of the tips in an array are essentially identical in characteristics. Tips of uniform height and sharpness are accomplished by the careful selection of mask 30 material size, and thickness.

Figure 5:
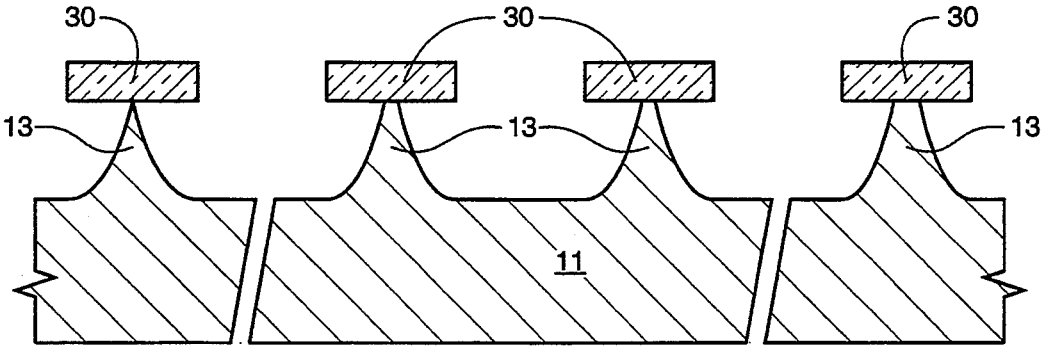
FIG. 5 is a cross-sectional schematic drawing of the structure of FIG. 4, as the etch proceeds according to the process of the present invention, illustrating that some of the tips become sharp before other tips.
Figure 6:
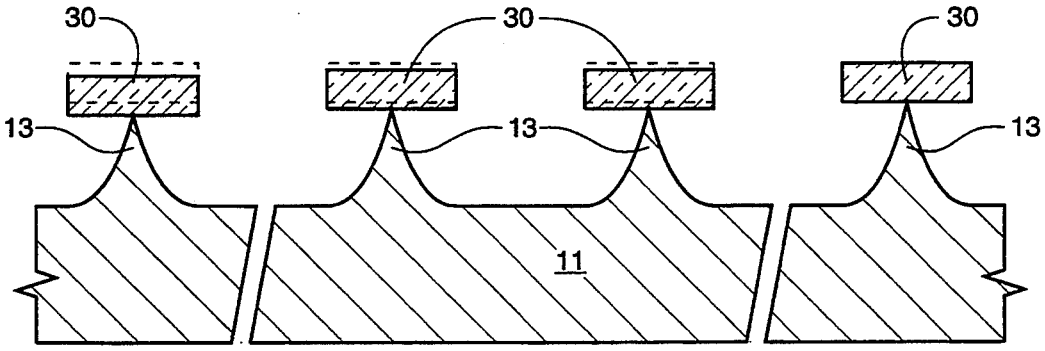
FIG. 6 is a cross-sectional schematic drawing of the structure of FIG. 5, as the etch proceeds according to the process of the present invention, illustrating that the tips become substantially uniform with the mask in place.
Figure 7:
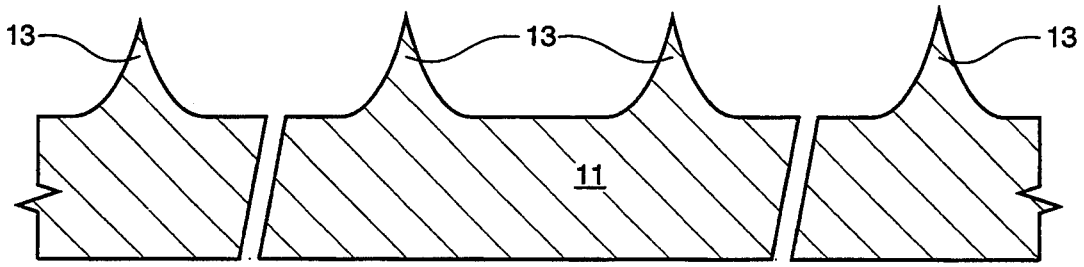
FIG. 7 is a cross-sectional schematic drawing of the structure of FIG. 6, depicting the sharp cathode tip after the etch has been completed, and the mask layer has been removed.
Figure 8:
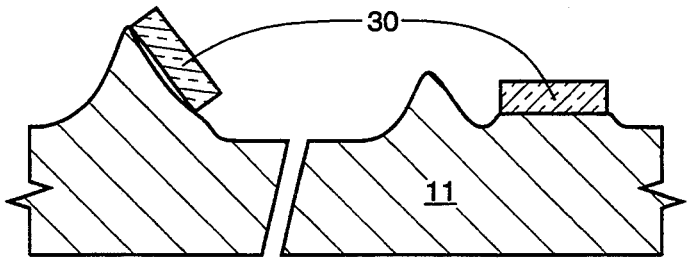
FIG. 8 is a cross-sectional schematic drawing of the malformed structure which would result if the mask layer is dislodged from the tips during the etch.

After the array of emitter tip 13 has been fabricated, and the desired dimensions have been achieved, the oxide mask layer 30 can be removed, as depicted in FIG. 5. The mask layer 30 can be stripped by any of the methods well known in the art, for example, a wet etch using a hydrofluoric acid (HF) solution or other HF containing mixture.

All of the U.S. patents and patent applications cited herein are hereby incorporated by reference herein as if set forth in their entirety.

While the particular process for creating sharp emitter tips for use in flat panel displays as herein shown and disclosed in detail is fully capable of obtaining the objects and advantages herein before stated, it is to be understood that it is merely illustrative of the presently preferred embodiments of the invention and that no limitations are intended to the details of construction or design herein shown other than as described in the appended claims. For example, the process of the present invention was discussed with regard to the fabrication of uniform arrays of sharp emitter tips for use in flat panel displays, however, one with ordinary skill in the art will realize that such a process can applied to other field ionizing and electron emitting structures, and to the micro-machining of structures in which it is desirable to have a sharp point, such as a probe tip, or a device.

What is claimed is:

1. A method for forming a substantially uniform array of sharp emitter tips, comprising the following steps of:
masking a substrate, thereby defining a masked array;
plasma etching said substrate to form an array of pointed tips, said plasma etching of said substrate continuing after full undercut while said mask remains balanced on said pointed tips; and
removing said mask when substantially all of said tips have become sharp.

2. The method according to claim 1, wherein said mask is a hardmask.

3. The method according to claim 2, wherein said mask is patterned as an array of circles.

4. The method according to claim 3, wherein said circles have a diameter, said diameter being in an approximate range of 1 μm.

5. The method according to claim 4, wherein said etching continues on any of said tips that becomes sharp until a substantial majority of said tips are sharp.

6. A process forming a substantially uniform array of sharp tips, comprising the following steps of:
masking a substrate;
etching said masked substrate to form an array of sharp tips, said etching continues until a majority of said tips of the array are of substantially uniform sharpness after full undercut, while said mask remains balanced on said tips; and
removing said mask.

7. The process according to claim 6, wherein said mask is balanced superjacent said majority of tips of said array until said substantially uniform sharpness is achieved.

8. The process according to claim 7, wherein said etching comprises:
performing a dry etch for approximately 2.3 minutes; and
overetching said tips for a time.

9. The process according to claim 8, wherein said dry etch comprises a fluorocarbon and an inert gas.

10. The process according to claim 9, wherein said over-etching continues after full undercut is achieved.

11. The process according to claim 10, wherein said substrate comprises single crystal silicon.

12. The process according to claim 11, wherein said tips function as electron emitters.

13. A method of etching an array of sharp tips, such that the tips have substantially the same height and shape, comprising the following steps of:
masking a substrate;
selectively removing portions of said substrate thereby forming an array of mask-covered tips, said selective removing of said portions of said substrate continues after full undercut while said mask remains balanced on said mask-covered tips; and removing said mask when a substantial majority of said mask-covered tips resemble a plane poised on a fulcrum.

14. The process according to claim 13, wherein said substantial majority of said mask-covered tips have a substantially identical height.

15. The process according to claim 14, wherein said substantial majority of said mask-covered tips have an apex angle which is substantially identical.

16. The process according to claim 15, further comprising the step of:

disposing silicon dioxide on said substrate prior to said masking.

17. The process according to claim 16, wherein said masking further comprises depositing a layer of resist on said silicon dioxide.

18. The process according to claim 17, wherein said silicon dioxide has depth in the approximate range of 0.1 μm.

19. The process according to claim 18, wherein said mask is patterned as an array of circles.

20. A process for micro-machining a tapered structure, comprising:

masking a substrate; and plasma etching said substrate beyond full undercut while said mask remains balanced on the tapered apex of the structure.

21. The process according to claim 20, wherein said structure comprises at least one of a tip and an edge.

22. The process according to claim 21, wherein said structure is disposed in an electron emitting device.

23. The process according to 22, wherein said substrate comprises amorphous silicon.

24. The process according to 22, wherein said substrate comprises single crystal silicon.

* * * * *